United States Patent [19]

Hiller et al.

[11] 4,198,723

[45] Apr. 22, 1980

[54] MULTI-ELEMENT PAINT ROLLER

[75] Inventors: Robert E. Hiller, Salisbury, Md.; Christopher Lawlor, North Ridgeville, Ohio

[73] Assignee: The Sherwin-Williams Company, Cleveland, Ohio

[21] Appl. No.: 922,298

[22] Filed: Jul. 6, 1978

[51] Int. Cl.[2] ..... B05C 17/02

[52] U.S. Cl. ..... 15/230.11

[58] Field of Search ..... 15/27, 99, 230.11, 248 A; 101/328–331; 401/21, 22, 147, 197, 208, 218–220

[56] References Cited

U.S. PATENT DOCUMENTS

| | | | |
|---|---|---|---|
| 206,909 | 8/1878 | Weber | 401/208 |
| 437,437 | 9/1890 | Johnson | 101/331 |
| 950,277 | 2/1910 | Currenti et al. | 101/329 |
| 2,187,585 | 1/1940 | Grigas | 15/230.11 |
| 3,149,365 | 9/1964 | Adair | 401/208 |
| 3,813,723 | 6/1974 | Jerry | 15/99 X |
| 3,825,970 | 7/1974 | Hanssen | 15/248 A X |
| 3,970,396 | 7/1976 | Brady | 15/230.11 |

FOREIGN PATENT DOCUMENTS

| | | | |
|---|---|---|---|
| 167837 | 3/1951 | Austria | 101/329 |
| 2439065 | 2/1975 | Fed. Rep. of Germany | 15/248 A |
| 2333584 | 7/1977 | France | 15/248 A |
| 79913 | 6/1919 | Switzerland | 401/21 |

*Primary Examiner*—Philip R. Coe
*Attorney, Agent, or Firm*—James V. Tura

[57] ABSTRACT

A multi-element paint applicator including a housing or splatter-guard, a roller assembly including at least two cylindrical rollers arranged in parallel, mounting the rollers within the housing, and a handle centrally disposed on the housing. The rollers are disposed within the housing so that the weave of the cover of the first roller is the reverse of the weave of the second roller to provide a smooth painted surface.

2 Claims, 5 Drawing Figures

MULTI-ELEMENT PAINT ROLLER

This invention relates to a paint applicator. In particular, this invention relates to a multi-element paint applicator for effective, splatter-free painting.

BACKGROUND OF THE INVENTION

Paint applicators of the roller type have extensively replaced other applicators such as brushes in both commercial and domestic applications, primarily owing to the much greater amounts of paint which can be applied in a single stroke of the roller-type applicators. Conventional paint applicators of the roller type typically comprise a single roller rotatably engaged with a handle and are customarily employed in conjunction with a shallow paint pan, from which the paint is applied to the roller. Such devices, while functioning to apply paint over a larger area than can be achieved with standard brush strokes, customarily have certain disadvantages, such as a tendency to splash the operator of the device and a tendency to mark the painted surface with the pattern of the roller cover unless very expensive roller covers are employed. Further, unless the paint is carefully distributed over the roller, the single roller applicators have a tendency to skip, particularly if the surface being treated is not absolutely level.

In order to overcome these disadvantages, prior art devices have been developed. For example, single roller paint applicators have been provided with housings intended to serve as splatter guards, such as those exemplified by U.S. Pat. Nos. 3,942,209 to Walls; 3,825,970 to Hanssen; 3,029,458 to Balicki; 2,887,707 to Heintzlman; 3,115,659 to Church; 3,378,872 to Frontera et al; 3,409,929 to Fisher, and 3,538,532 to Shortino et al. Such splatter guards have the inherent disadvantage of tending to tilt in use, particularly if the handle is centrally mounted as in U.S. Pat. No. 3,825,970, or of being very unwieldy if the handle is laterally engaged with the roller, as in U.S. Pat. No. 3,942,209, or both. Inadvertent tilting of the housing or splatter guard frequently results in marking of the painted surface, requiring additional effort to repair the damage and also accumulating paint on the housing, which in turn is subject to dripping.

In order to overcome the disadvantages associated with single roller applicators, multi-roller applicators such as described in U.S. Pat. Nos. 3,130,435 to Smith; 3,409,929 to Fisher, or 2,257,316 to Smith have been proposed, which increase the amount of paint applicable with a single stroke. Housings for said rollers, however, tend to be extremely unwieldy, particularly when the handle is off-set, as described in U.S. Pat. No. 3,409.929. Other multi-roller applicators, such as described in U.S. Pat. No. 2,257,316 have a tendency to splatter, are difficult to load with paint, and further, tend to leave marks on the painted surface, owing to the use of similar covers on the rollers.

Accordingly, it is an object of the present invention to provide a multi-element paint applicator which is convenient to use.

It is a further object of this invention to provide a multi-element paint applicator which substantially minimizes splatter and yet does not tend to mar the adjacent painted surfaces.

It is yet another object of this invention to provide an efficient paint applicator which effectively applies a greater amount of paint to a larger area and which also provides a smooth painted surface.

Other objects and advantages of the invention will be apparent from the description thereof and the appended claims.

SUMMARY OF THE INVENTION

The multi-element paint applicator of the invention includes a housing or splatter-guard, a roller assembly including at least two cylindrical rollers arranged in parallel and mounting means for mounting the rollers within the housing, and a handle centrally disposed on the housing for manipulating the applicator.

The applicator housing or splatter-guard broadly comprises a generally box-like structure of rectangular proportions for accommodating the roller elements of the applicator. The housing may be formed of any suitable material which is both rigid and durable such as acrylic or vinyl plastics.

The rollers, which are preferably two in number, are each rotatably and removably engaged within said housing and spaced therefrom and from each other. Each of the rollers includes paint-delivery means for delivering paint to the surface to be painted comprising a conventional cleanable cover. Preferably, each of the covers are of the same material and the two rollers are disposed within the housing so that the weave of the cover of the first roller is the reverse of the weave of the cover of the second roller; any pattern left in the painted surface by the first roller will be thus substantially cancelled as the second roller moves over this pattern, leaving a comparatively smooth painted surface, even when less expensive roller covers of a coarser weave are employed. Preferably, each of the rollers comprises a disposable, lightweight cylinder having a hollow bore therewithin and a cover affixed to the outer surface thereof, of the type presently commercially available. In an alternate embodiment of the invention, the paint-delivery means comprises an endless belt driven by the rollers.

The applicator of the invention further includes mounting means for demountably and rotatably engaging the roller elements within the housing such as, for example, axially aligned bores in the opposing side walls of the housing for receiving axially projecting shaft elements disposed at opposite ends of each of the roller elements. Preferably, the mounting means comprises first and second plug elements, of the type described for example in U.S. Pat. No. 3,825,970, supra, each receivable within one of the end portions of the hollow bore of the roller element. The plug elements each carry an axially projecting stub shaft on the outer surface thereof for removable engagement with corresponding first and second axially aligned bores in the applicator housing.

The handle of the applicator is pivotally engaged with the housing on the outer surface thereof, and is centrally engaged so that the work-performing portion of the applicator is nicely balanced in use, thereby facilitating an even application of paint to the substrate surface. Preferably, the handle includes fastening means, such as a threaded recess in the distal portion thereof, for fastening an extension thereto to permit the operator to reach remote areas, such as ceilings and the upper portions of walls, with the applicator.

The invention thus provides a well-balanced, splatter-resistant paint applicator which in operation rapidly distributes a smooth, unpatterned coat of paint over a large area, without concomitant marring of the painted surface by elements of the applicator.

DETAILED DESCRIPTION OF THE DRAWING

Figure 1:
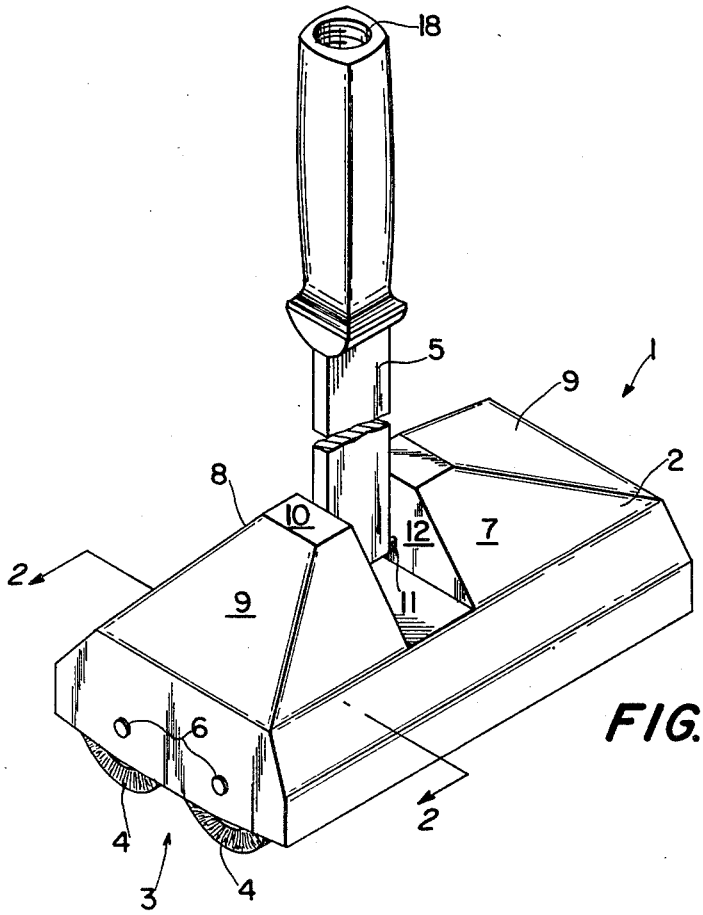
FIG. 1 is a perspective view of one embodiment of the multi-element paint applicator of this invention particularly illustrating the splatter-guard housing and the roller assembly.
Figure 2:
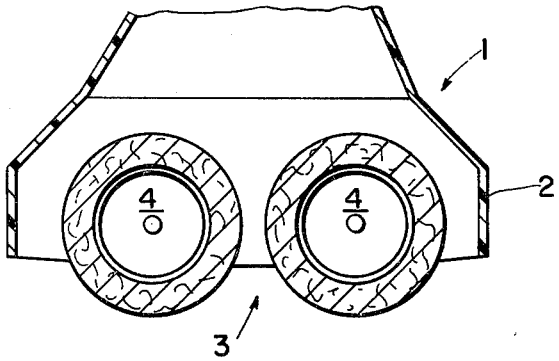
FIG. 2 is a cut-away side view of the multi-element paint applicator of FIG. 1, illustrating the housing in cross-section, and the rollers spaced within.

With particular reference to FIGS. 1 and 2, the multi-element paint applicator of the invention is generally indicated at 1.

The applicator 1 includes a box-like splatter-guard or housing 2 and a roller assembly generally indicated at 3 comprising a pair of hollow-bore cylindrical rollers 4 and associated mounting means generally indicated at 6 for removably mounting the rollers 4 in parallel within the splatter-guard 2. The applicator 1 further includes a handle 5, having a threaded bore 18 at the distal portion thereof for engaging an extension (not shown) matingly threaded at one end thereof. The splatter-guard 2 is of generally rectangular proportions and includes elongated forward and rearward sides 7 and 8 respectively, opposing shorter sides 9 and a top 10, which are formed of rigid, yet somewhat flexible, material, such as vinyl or acrylic resin. The upper portions of forward side 7 and rearward side 8 are angled inwardly toward the top 10 and the handle 5 is pivotally centrally engaged in the top 10 by a pivot pin 11 disposed between downwardly projecting ears 12 at the midsection of the top 10.

Figure 3:
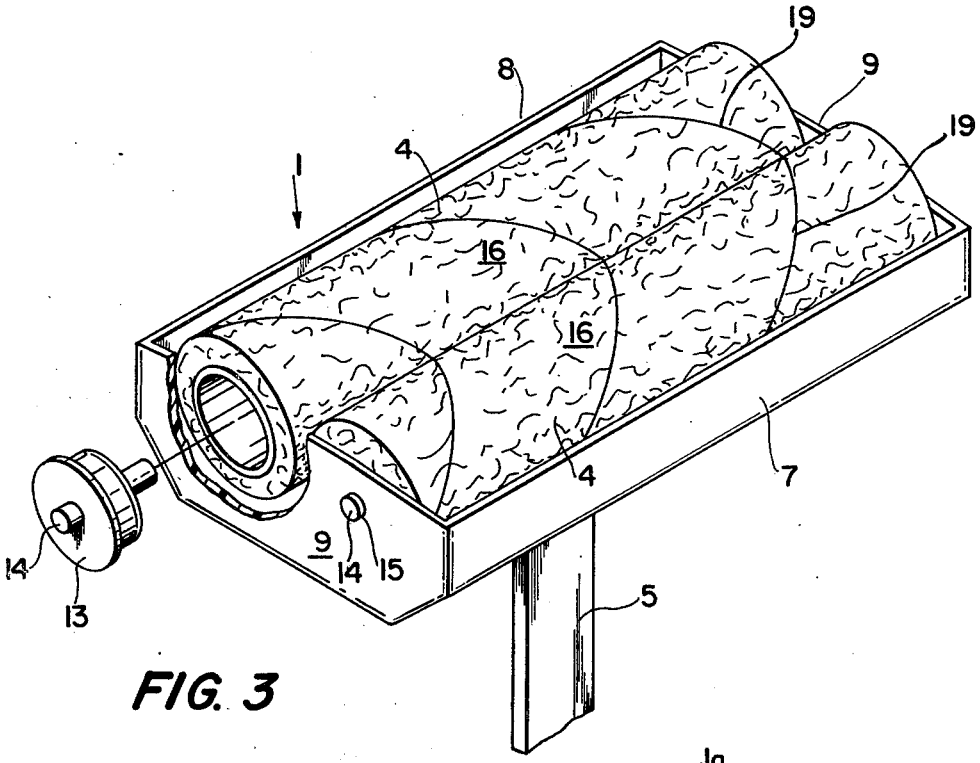
FIG. 3 is an exploded view of the roller mounting means of the applicator of FIG. 1 and a perspective view of the roller assembly, illustrating the opposing weaves of the roller covers.

As best seen in FIG. 3, the roller mounting means 6 includes discoid plug elements 13 which are frictionally engageable into the open ends of the hollow bore rollers 4. Each of the plug elements 13 carries an axially projecting stub shaft 14 receivable into one of four bores 15 which are axially aligned in pairs in the opposing shorter sides 9 of the splatter-guard 2 to accommodate the rollers 4 in parallel with the forward and rearward sides 7 and 8 of the splatter-guard 2. The rollers 4 with the associated plug elements 13 are sufficiently longer than the forward and rearward sides 7 and 8 of the splatter-guard 2 so that the rollers 4 are retained within the splatter-guard 2 by the interaction of the stub shafts 14 with the bores 15.

As best seen also in FIG. 3, each of the hollow-bore cylindrical rollers 4 includes a roller cover 16 having a seam 19 which functions as a paint distributing surface. The rollers 4 are disposed in the splatter-guard 2 so that the weaves of the covers 16 travel in opposite directions, cancelling marks left by the weaves or by the seams 19.

Figure 5:
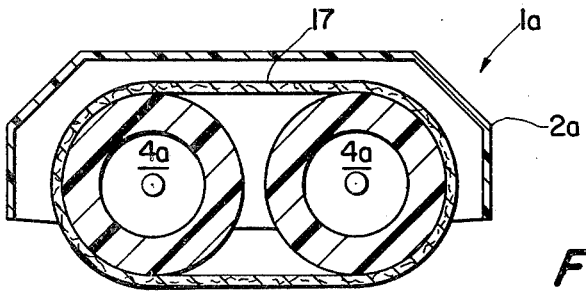
FIG. 5 is a cut-away side view of the multi-element paint roller of FIG. 4 particularly illustrating the housing in cross-section.
Figure 4:
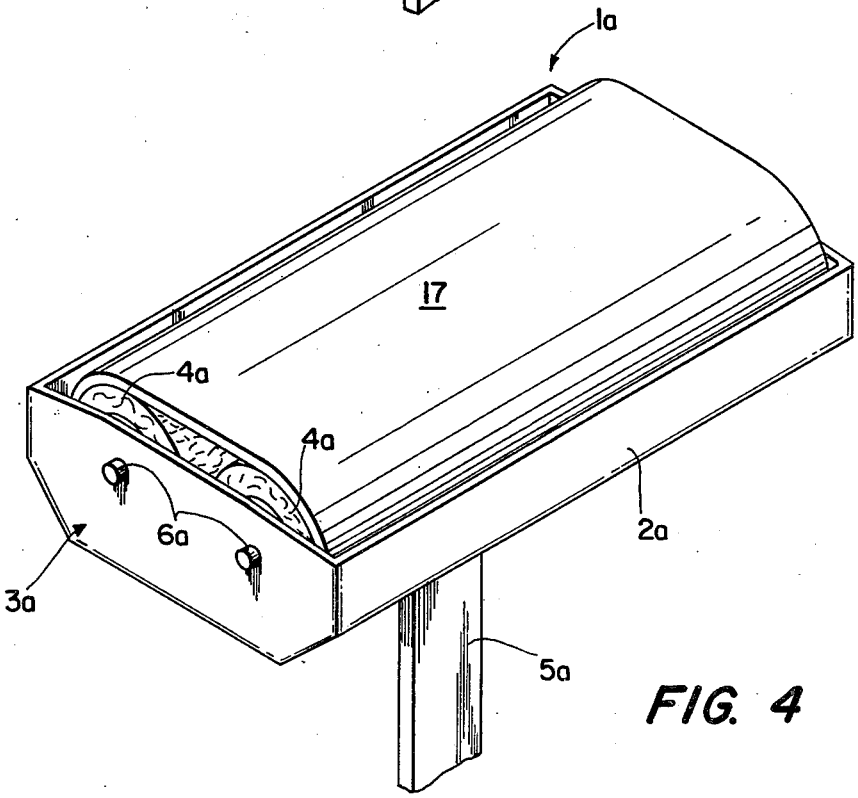
FIG. 4 is a perspective view of an alternate embodiment of the multi-element paint roller of this invention, particularly illustrating the housing and associated roller assembly.

FIGS. 4 and 5 illustrate a similar applicator 1*a*, having a housing 2*a* with a handle 5*a* and a roller assembly generally indicated at 3*a* comprising a pair of hollow bore cylindrical rollers 4*a* and associated mounting means generally indicated at 6*a* for mounting the rollers within the splatter-guard 2*a*. The splatter-guard 2*a* is generally in the shape of a truncated pyramid as shown in FIG. 5 in cross-section. The rollers 4*a* include a single roller cover or endless belt 17 as a paint-distributing surface which is driven by the rollers 4*a*. The belt 17 is removable from the rollers 4*a* for cleaning or for disposal.

In use, paint is applied to the paint-distributing surface of the applicator from a conventional shallow paint pan, and the paint is applied by rolling the applicator 1 over the surface to be painted. Owing to the presence of the two rollers, a much greater amount of paint can be delivered with a single stroke than is possible with conventional single-roller applicators; and a particularly efficient application of paint can be obtained by use of the embodiment of the applicator 1*a* of FIGS. 4 and 5. Further, the centrally disposed handle 5 permits a relatively effortless application. Again, owing to the presence of the two rollers 4, the splatter-guard 2 is not subject to tilting, and a substantially mar-free painted surface is obtained by the applicator 1, both as a result of the stability of the splatter-guard 2, and as a result of the opposing crossweaves of the roller covers 16, whereby any pattern left on the painted surface by the cover of the first roller will tend to be cancelled by the opposite pattern on the cover of the second roller.

For cleaning, the rollers 4 are disengaged from the splatter-guard 2 by deflection of the shorter sides 9 until the stub shafts 14 are disengaged from the bores 15. The roller covers 16 or the roller belt 17 may then be cleaned or replaced, or the entire roller unit including the rollers 4 and the covers 16 or belt 17, replaced.

Further embodiments will be apparent to those skilled in the art, without departing from the invention as described and claimed.

What is claimed is:

1. A multi-element paint applicator comprising
(a) a housing;
(b) a roller assembly including first and second cylindrical hollow bore rollers and paint delivery means for delivering paint to a substrate comprising substantially identical first and second woven covers affixed to the outer surface of the first and second rollers, respectively, said rollers being disposed within the housing so that the weave of the first woven cover opposes the weave of the second woven cover;
(c) mounting means for demountably and rotatably engaging said rollers in parallel within said housing; and
(d) a handle substantially centrally located relative to the outer surface of said housing and operatively engaged to the roller assembly.

2. A multi-element paint applicator comprising
(a) a substantially box-like housing of rectangular proportions having elongated forward and rearward side portions, shorter opposing side portions each having at least one bore therein, and a top portion;
(b) a pair of hollow bore cylindrical rollers, having open ends, each of said rollers further including a discoid plug element removably engageable in each of the open ends thereof, said plug elements each having an axially aligned stub shaft which is engageable with one of said bores in said shorter opposing side portions of said housing;

(c) mounting means for demountably and rotatably engaging said rollers within said housing parallel to said forward and rearward side portions in spaced relationship thereto and to each other comprising said discoid plug elements and the bore in said shorter opposing sides of each said housing for rotatably engaging said stub shafts;

(d) paint delivery means associated with said rollers for delivering paint from the rollers to a surface to be painted, and said paint delivery means comprising substantially identical first and second woven covers affixed to the outer surface of the first and second rollers, respectively, said rollers being disposed within the housing so that the weave of the first woven cover opposes the weave of the second woven cover; and (e) a handle pivotally and operatively engaged with the rollers and located at the outer surface of said housing near the midsection of said top portion thereof for manipulating said applicator over the surface to be painted.

* * * * *